US008544672B2

(12) United States Patent
Tate et al.

(10) Patent No.: US 8,544,672 B2
(45) Date of Patent: Oct. 1, 2013

(54) COLLAPSIBLE SAFETY BEVERAGE COVER

(76) Inventors: Ronald David Tate, Greentown, IN (US); Jeffrey Ronald Tate, Greentown, IN (US)

( * ) Notice: Subject to any disclaimer, the term of this patent is extended or adjusted under 35 U.S.C. 154(b) by 0 days.

(21) Appl. No.: 13/528,318

(22) Filed: Jun. 20, 2012

(65) Prior Publication Data

US 2013/0015187 A1 Jan. 17, 2013

Related U.S. Application Data

(60) Provisional application No. 61/506,246, filed on Jul. 11, 2011.

(51) Int. Cl.
*B65D 51/00* (2006.01)

(52) U.S. Cl.
USPC ..... 220/287; 220/8; 220/351; 220/666; 220/713; 220/780; 220/907; 215/45; 215/228; 215/229

(58) Field of Classification Search
USPC ..... 220/8, 287, 351, 666, 713, 780, 907; 215/45, 228, 229
See application file for complete search history.

(56) References Cited

U.S. PATENT DOCUMENTS

| | | | | |
|---|---|---|---|---|
| 879,753 | A * | 2/1908 | Eckert | 220/8 |
| 1,093,873 | A * | 4/1914 | Mitchell | 220/8 |
| 2,438,434 | A * | 3/1948 | Friedman | 220/8 |
| 3,285,459 | A * | 11/1966 | Gahm | 220/8 |
| 2006/0016820 | A1 * | 1/2006 | Himes et al. | 220/740 |
| 2009/0152272 | A1 | 6/2009 | Guptil | |
| 2011/0049153 | A1 | 3/2011 | Marceca et al. | |

* cited by examiner

*Primary Examiner* — Anthony Stashick
*Assistant Examiner* — Elizabeth Volz
(74) *Attorney, Agent, or Firm* — Frank D. Lachenmaier

(57) ABSTRACT

The present invention is a collapsible cover used to protect an open beverage container from tampering. It is compact and easy to carry and use, is attractive and may be decorated with sports team logos or University symbols or other works of art. It has deep enough extended side walls to prevent someone from unobtrusively removing it to contaminate the beverage and is not too cumbersome to carry in a purse or pocket. The collapsible cover is available in different diameters to allow covering beer or soda cans, bottles, mixed drink glasses or wine glasses. It also has an opening for inserting a straw so that the cover does not have to be removed to consume the beverage.

8 Claims, 6 Drawing Sheets

COLLAPSIBLE SAFETY BEVERAGE COVER

CROSS-REFERENCE TO RELATED APPLICATIONS

Provisional Patent Application: 61/506,246

STATEMENT REGARDING FEDERALLY SPONSORED RESEARCH OR DEVELOPMENT

Not Applicable

BACKGROUND OF THE INVENTION

The present invention is in the field of beverage container covers, more particularly, the present invention relates to a collapsible cover to protect an open beverage container from tampering. It is compact and easy to carry and use. A typical cap or cover that has deep enough side walls to prevent someone from unobtrusively removing it to contaminate the beverage is too cumbersome to carry in a purse or pocket. The collapsible cover is available in different diameters to allow covering beer or soda cans, bottles, mixed drink glasses or wine glasses.

With recent abductions and murders of young women from bars and night clubs gaining national attention, parents are justifiably worried about someone tampering with their children's drinks if they leave them unattended for any reason. Covers for beer or soft drink cans designed to keep bees or other insects out of outdoor refreshments have been unsuccessful resolving these issues as they are simply too bulky or unattractive to gain acceptance. Patent applications No. US 2006/016820 A1 published Jan. 26, 2006 to Himes et al.; No. 2009/0152272 A1 published Jun. 18, 2009 to Guptil; and No. 2011/0049153 A1, published Mar. 3, 2011 by Marceca et al. show different approaches to covering drinks outdoors to prevent dirt, leaves or bugs contaminating open containers but have not contemplated the safety, security, portability, attractiveness issues or resolved them.

SUMMARY OF THE INVENTION

The Collapsible Safety Beverage Cover is a device that fits over an open beverage container to prevent contamination of the beverage by someone intent on harming the beverage consumer. These covers are made in different diameters to loosely fit over standard glass sizes for mixed drinks or wine, aluminum cans or conventional bottles for soft drinks or beer. These covers need side walls approximately 1 inch deep to make removing the cover fairly obvious to the consumer. One inch deep covers however are bulky and would not fit easily into a purse or a pocket. This portability problem is resolved by making the covers collapsible. A typical cover would have 3 to 5 sections that when collapsed would be approximately 0.25 to 0.30 inches in height.

The advantages of the present invention without limitation will give patrons of night clubs and bars and their friends and parents confidence knowing they are protected from someone slipping a date rape drug or other harmful substance into their drink when they are not looking. The Collapsible Safety Beverage Cover minimizes the risk and lowers the anxiety of those that care about the consumers of beverages in a public place. The covers can be decorated with various logos for Universities, Professional sports teams or personalized with different indicia. The covers are supplied with an opening for a straw to eliminate the need to remove the cover to consume the beverage. They can also be supplied without the opening for a straw for covers such as those for wine glasses.

BRIEF DESCRIPTION OF THE DRAWINGS

Beverage containers are shown in broken lines for illustrative purposes only as they are not part of this invention.

DETAILED DESCRIPTION OF THE INVENTION

Figure 1:
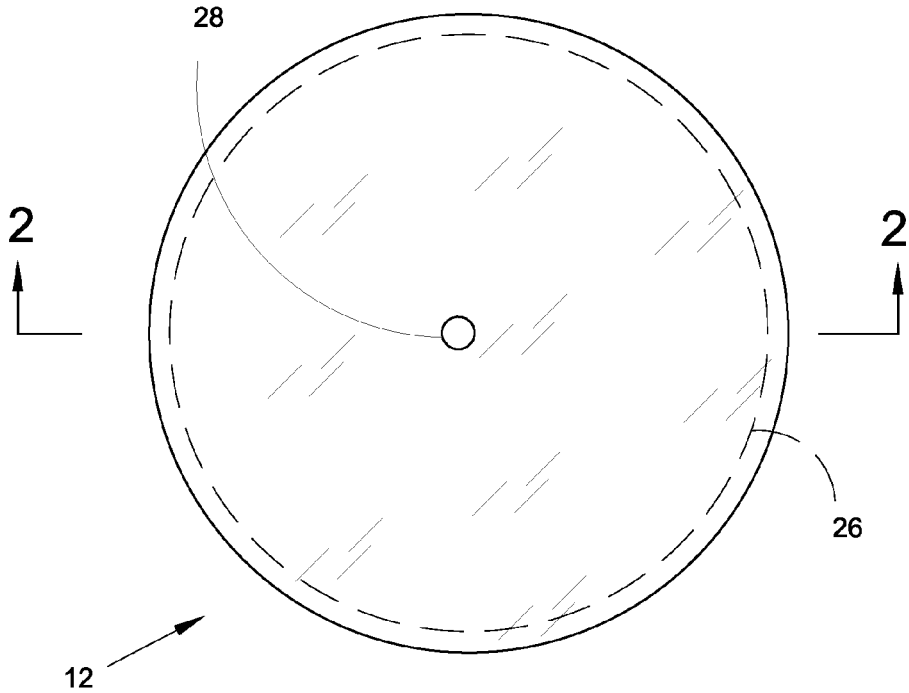
FIG. 1 is a top view of a Collapsible Safety Beverage Cover for 12 ounce beverage can showing an opening for a drinking straw and an area designated for logos, art works, or other personalization indicia.
Figure 2:
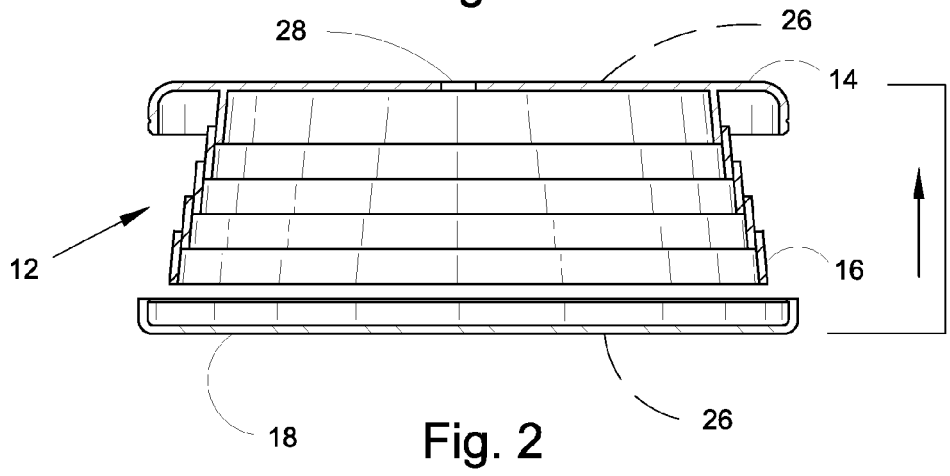
FIG. 2 is a section view from FIG. 1 taken along cutting plane 2-2 showing segments in the fully extended position with cap removed.
Figure 2A:
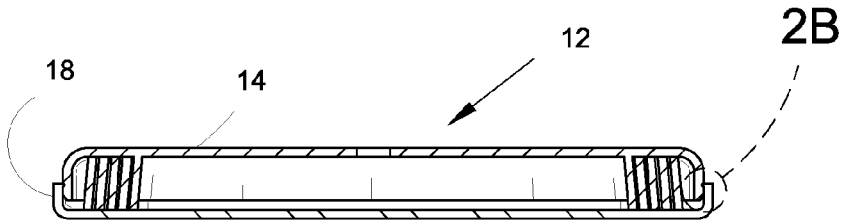
FIG. 2A is a section view from FIG. 1 along cutting plane 2-2 showing segments in the fully collapsed position with cap in place.
Figure 2B:
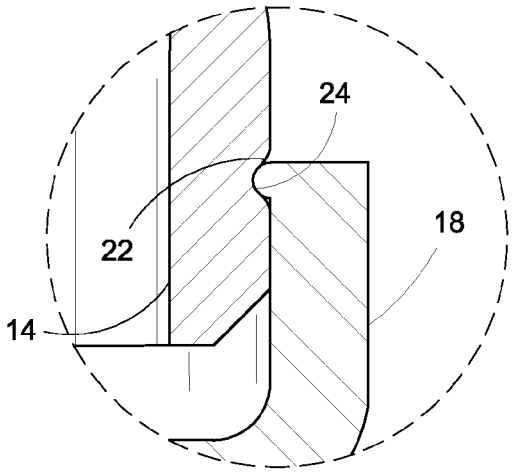
FIG. 2B is an enlarged partial section view showing the snapping feature that holds cap to cover.
Figure 3:
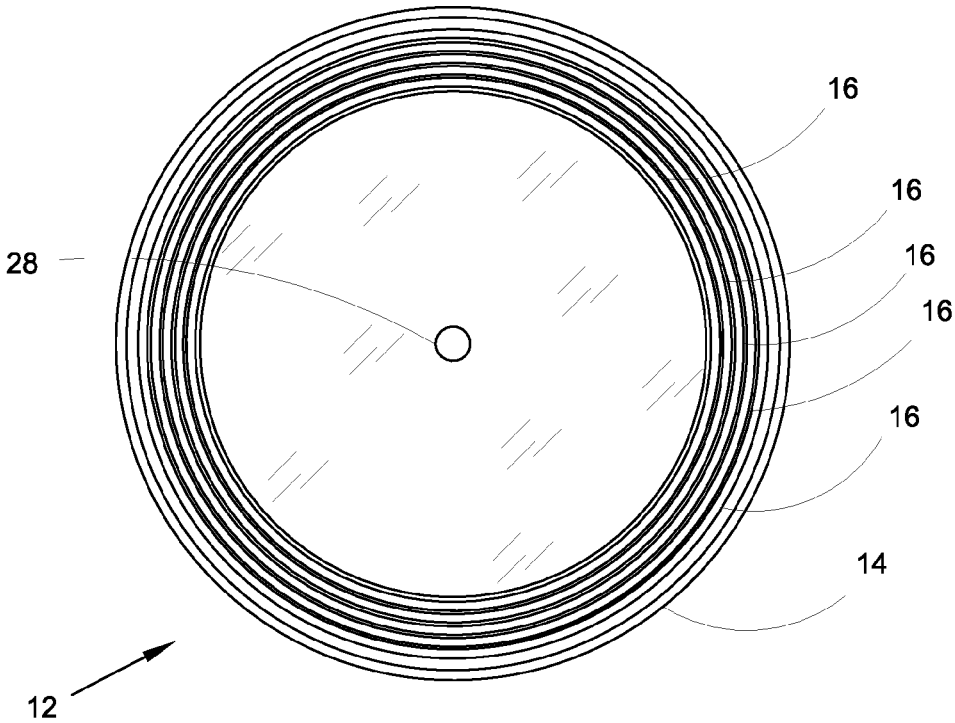
FIG. 3 is a bottom view of cover with segments extended without cap.
Figure 4:
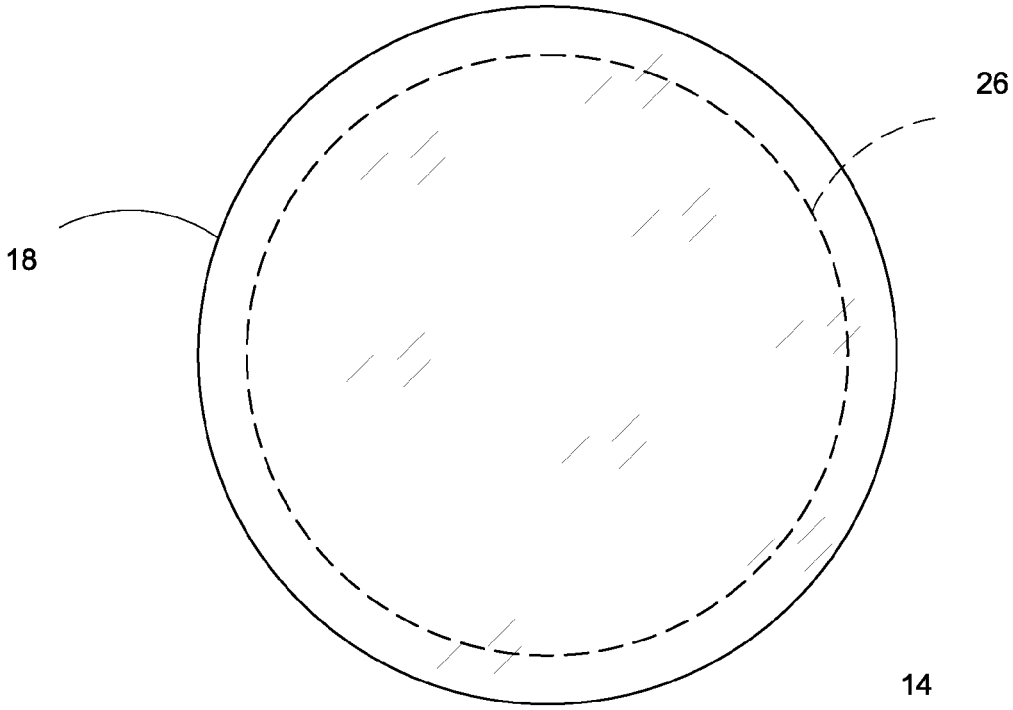
FIG. 4 is a bottom view of cap indicating its area available for logos, art work or other personalization indicia.

Similar parts will be referenced with common numerals throughout the several embodiments in the specification and the accompanying drawings. Collapsible Safety Beverage Cover 12, hereafter referred to as Cover 12, is used to protect an open top beverage container 20 from someone with nefarious intentions tampering with the beverage. Cover 12 keeps them from adding something such as a date rape drug to the beverage while the consumer is distracted. FIG. 1 shows a top view of Cover 12 designed to fit over a 12 ounce can 20. This view illustrates area 26 on top surface of case 14 for logos, art works or other personalization indicia and opening 28 for a drinking straw through top center of case 14. FIG. 2 is a section view taken along cutting plane 2-2 in FIG. 1 showing a fully extended Cover 12 designed to fit over 12 ounce can 20. FIG. 2A shows a fully collapsed Cover 12 designed to fit over a 12 ounce can 20 with cap 18 snapped in place over case 14 to keep cover 12 clean during transport or storage. FIG. 2B is an enlarged view of the partial section illustrated in FIG. 2A. FIG. 2B shows an enlarged sectional detail of the snap feature that keeps cap 18 in place when snapped over case 14. Cap 18 has a small internal bump 24 that extends radially inward, adjacent to top of the inside vertical wall of cap 18 that snaps into a matching cavity 22 depressed radially inward into the approximate axial center of the outside of depending vertical wall of case 14. Pressing the center of cap 18 and assembled case 14 between the thumb and forefinger causes the assembly to easily release bump 24 from cavity 22 allowing the separation of cap 18 from case 14 for utilization. A lead-in chamfer on the outside bottom diameter of case 14 allows for an easy assembly of cap 18 to case 14. The top surface of case 14 and the bottom surface of cap 18 have areas 26 designated for logos, art works, or other personalization indicia to be located.

Cover 12 consists of a plurality of truncated conical segments 16, case 14 and cap 18. The minor diameter of the truncated conical segment 16 is at the top and the major diameter of the truncated conical section 16 is at the bottom. Each conical segment 16 has a top inside diameter and a bottom outside diameter. The plurality of segments 16 fit concentrically within each other when collapsed. The top inside diameter of the bottom segment 16 is smaller than the bottom outside diameter of the adjacent segment 16. A plurality of segments 16 is concentrically stacked in order of descending diameters. Case 14 is placed over the concentrically stacked plurality of truncated conical segments 16 and the bottom surface of case 14 is attached to the top surface of innermost segment 16. The inside diameter of case 14 is larger than bottom outside diameter of the outermost segment 16 and has an axial depth of approximately the height of segment 16. Segments 16 collapse into case 14 and cleanliness in transport or storage is provided by cap 18 which snap-fits over case 14. Cap 18 is removed at the point of use and the plurality of segments 16 is extended. Cover 12 is placed over beverage container 20 to protect it from tampering.

Figure 5:
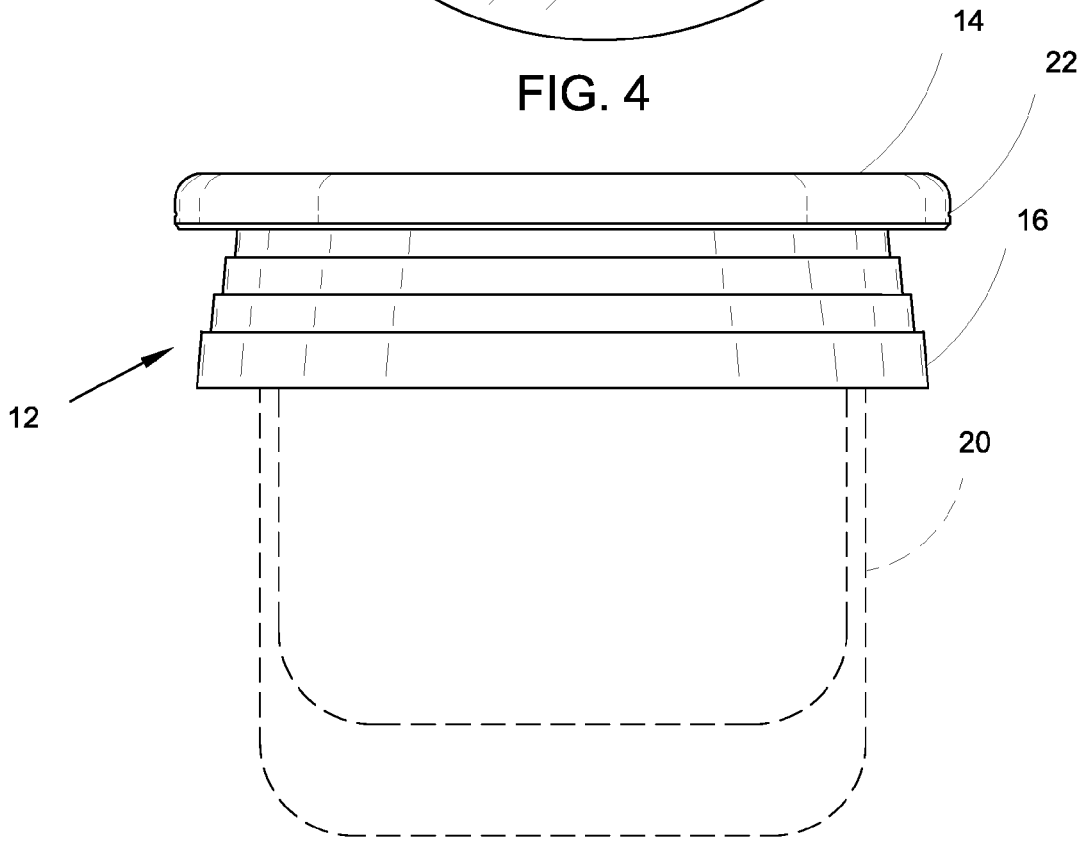
FIG. 5 is a side view of an extended cover mounted on a mixed drink glass.
Figure 6:
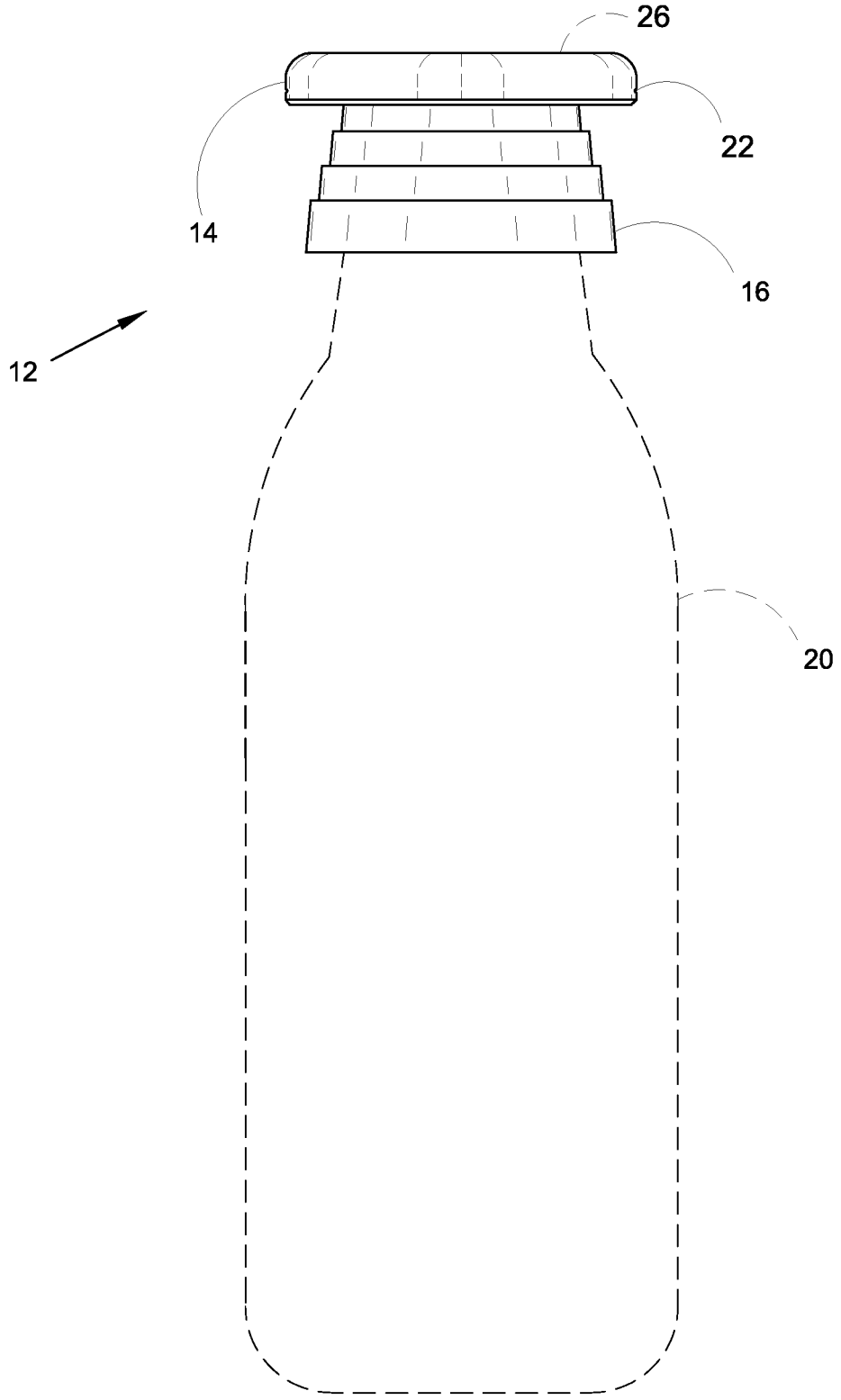
FIG. 6 is a side view an extended cover mounted on a 6 to 12 oz. bottle.
Figure 7:
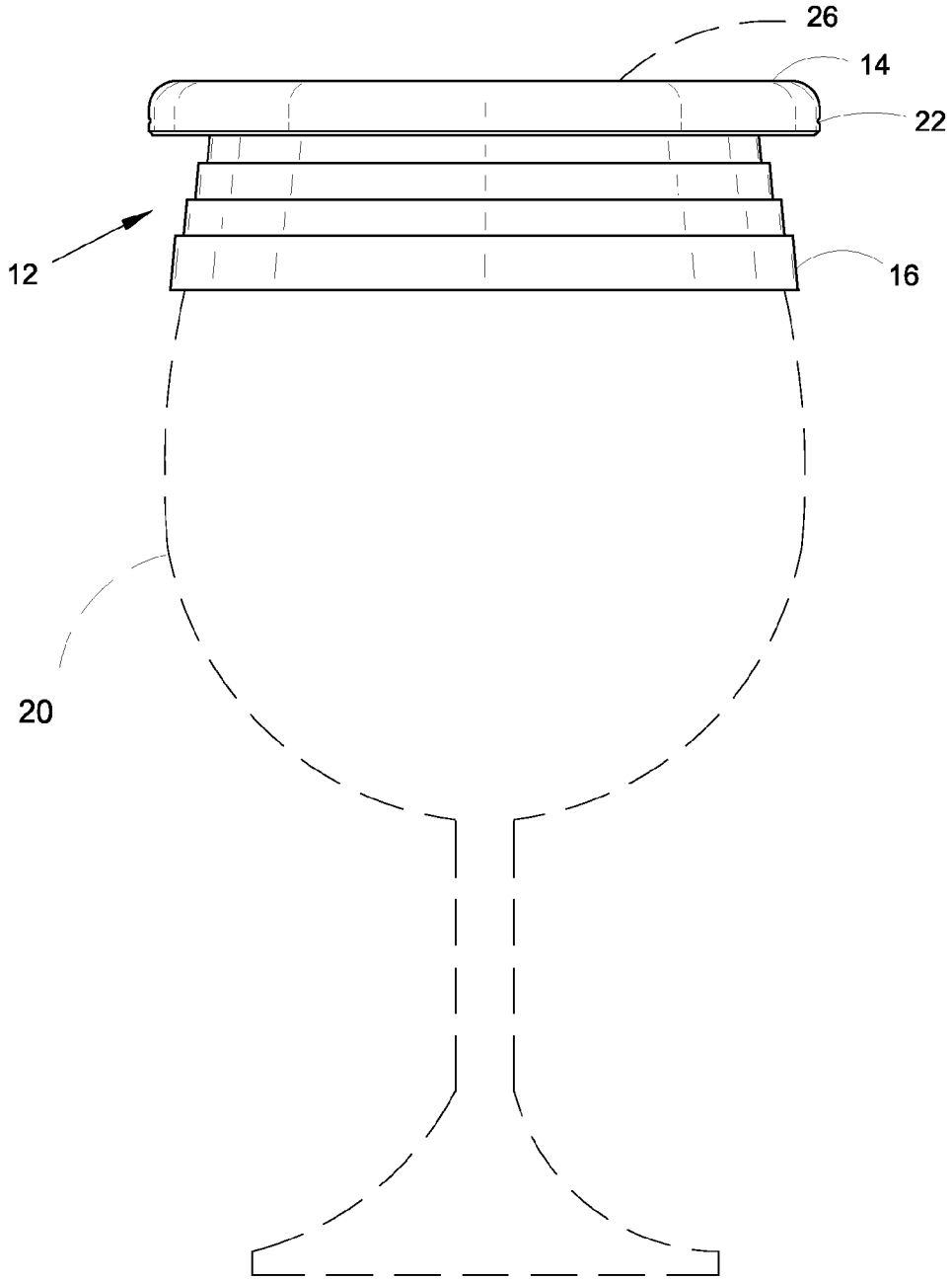
FIG. 7 is a side view of an extended cover mounted on a wine glass.
Figure 8:
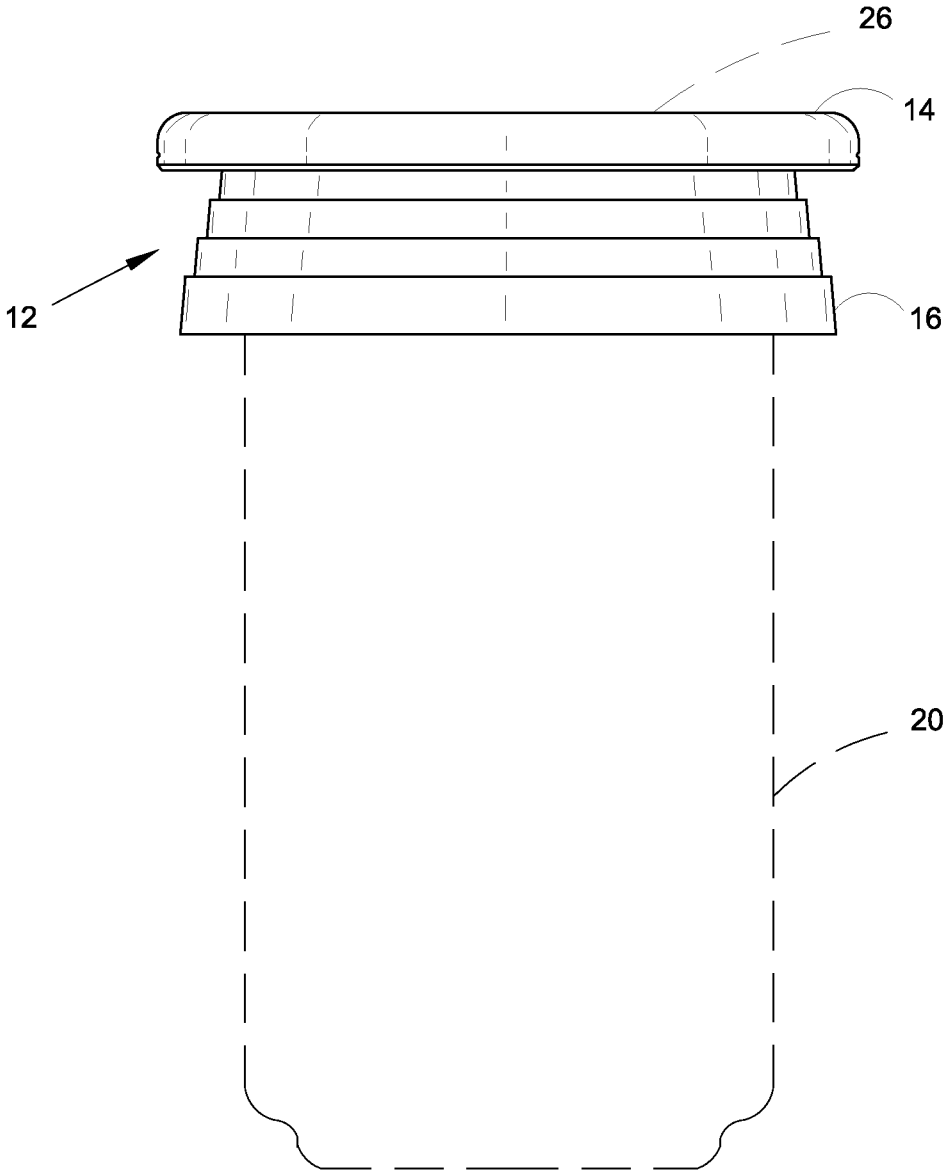
FIG. 8 is a side view of an extended cover mounted on a 12 oz. can.

Several exemplary embodiments are shown in FIGS. 5-8. The inside diameter for the innermost and smallest segment 16 for use on a mixed drink glass is approximately 3 inches as shown in FIG. 5. The inside diameter for the smallest segment 16 for use on 6-12 ounce bottles is approximately 1 Inch as shown in FIG. 6. The inside diameter for the innermost and smallest segment 16 for use on a wine glass is approximately 3½ inches as shown in FIG. 7. The inside diameter for the innermost and smallest segment 16 for use on a 12 ounce can is approximately 2¾ inches and is shown in FIG. 8. Cover 12 is preferably constructed of plastic, rubber or stainless steel or other suitable materials. Depending on the quality levels desired it can even be made from disposable materials. Segments 16 are approximately 0.25 to 0.30 inches in axial height with typically an approximate 5 degree draft on segment 16 side walls. Segments 16 are typically 0.040 to 0.060 inches in wall thickness. Assembly techniques used to manufacture Cover 12 are standard manufacturing processes such as injection molding, heat staking, friction welding, sonic welding, and adhesives. The size, shape, materials, and manufacturing processes for Cover 12 are not limited to those mentioned here.

While the foregoing written descriptions of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods within the scope and spirit of the invention.

The invention claimed is:

1. A collapsible safety beverage cover comprising:

a plurality of truncated conical segments each with radially diminishing diameters from the outermost segment to the innermost segment, each with a common slope, a top surface, an axial height, a top inside diameter, a bottom outside diameter wherein said plurality of truncated conical segments slip fit concentrically within each other with a minor diameter at the axial top of said segment and a major diameter at the axial bottom of said segment and said top inside diameter of said segment is smaller than said bottom outside diameter of the radially internal segment;

a case with a top and bottom surface in a circular platform with a depending peripheral side wall approximately the same axial height as said segments that has an inside diameter larger than said bottom outside diameter of the outermost segment; wherein said depending peripheral side wall has a recessed cavity running around external perimeter of said side wall at its approximate axial mid-point; wherein said plurality of segments are placed within each other and said top surface of said innermost segment is concentrically attached to said bottom surface of said case such that when said outermost segment is pulled axially away from said case it draws the internal segments with it, such that when placed over a beverage container the segments extend below the top of said beverage container making it more difficult to unobtrusively remove said collapsible safety beverage cover; wherein the interference between the smaller top inside diameter of said segment and the larger bottom outside diameter of the internally adjacent segment limits said segments movement and prevents them from separating completely;

a cap with a circular platform, an upstanding peripheral wall with an inside diameter a slip fit larger than said outside diameter of said case to be placed over collapsed segments mounted on said case for cleanliness during transport or storage; wherein said upstanding peripheral side wall has a bump extending radially inward adjacent to the top of said upstanding side wall such that when segments are collapsed into said case and said cap is installed over said case said radially extended bump drops into said cavity on said case retaining assembly for transport or storage; and where said to surface of said case has an opening for a drinking straw.

2. The collapsible safety beverage cover according to claim 1 wherein said case, segments and cap are a predetermined color.

3. The collapsible safety beverage cover according to claim 1 wherein said case top surface and cap bottom surface display indicia of universities, sports teams or personalization with other works of art.

4. The collapsible safety beverage cover according to claim 1 wherein said case top surface and cap bottom surface display advertising, interesting or amusing quotes or sayings.

5. A collapsible safety beverage cover comprising:

a plurality of truncated conical segments each with radially diminishing diameters from the outermost segment to the innermost segment, each with a common slope, a top surface, an axial height, a top inside diameter, a bottom outside diameter wherein said plurality of truncated conical segments slip fit concentrically within each other with a minor diameter at the axial top of said segment and a major diameter at the axial bottom of said segment and said top inside diameter of said segment is smaller than said bottom outside diameter of the radially internal segment;

a case with a top and bottom surface in a circular platform with a depending peripheral side wall approximately the same axial height as said segments that has an inside diameter larger than said bottom outside diameter of the outermost segment; wherein said depending peripheral side wall has a recessed cavity running around external perimeter of said side wall at its approximate axial mid-point; wherein said plurality of segments are placed within each other and said top surface of said innermost segment is concentrically attached to said bottom surface of said case such that when said outermost segment is pulled axially away from said case it draws the internal segments with it, such that when placed over a beverage container the segments extend below the top of said beverage container making it more difficult to unobtrusively remove said collapsible safety beverage cover; wherein the interference between the smaller top inside diameter of said segment and the larger bottom outside diameter of the internally adjacent segment limits said segments movement and prevents them from separating completely; and where said top surface of said case has an opening for a drinking straw.

6. The collapsible safety beverage cover according to claim 5 wherein said case top surface displays indicia for universities, sports teams or personalization with other works of art.

7. The collapsible safety beverage cover according to claim 5 wherein said case, segments and cap are a predetermined color.

8. The collapsible safety beverage cover according to claim 5 wherein said case top surface and cap bottom surface display advertising, interesting or amusing quotes or sayings.

* * * * *